US007964096B2

(12) United States Patent
Kimisawa et al.

(10) Patent No.: US 7,964,096 B2
(45) Date of Patent: Jun. 21, 2011

(54) FILTER DEVICE UTILIZING RETURNED FUEL TO PROLONG FILTER LIFE

(75) Inventors: Toshihide Kimisawa, Nisshin (JP); Yasushi Ueki, Yokohama (JP)

(73) Assignee: Nifco, Inc., Yokohama (JP)

( * ) Notice: Subject to any disclaimer, the term of this patent is extended or adjusted under 35 U.S.C. 154(b) by 0 days.

(21) Appl. No.: 12/224,837

(22) PCT Filed: Feb. 28, 2007

(86) PCT No.: PCT/JP2007/053743

§ 371 (c)(1),
(2), (4) Date: Oct. 30, 2008

(87) PCT Pub. No.: WO2007/108285

PCT Pub. Date: Sep. 27, 2007

(65) Prior Publication Data

US 2009/0050551 A1 Feb. 26, 2009

(30) Foreign Application Priority Data

Mar. 17, 2006 (JP) ..... 2006-074711

(51) Int. Cl.
*F02M 37/22* (2006.01)
*F02M 37/10* (2006.01)

(52) U.S. Cl. ..... 210/172.4; 210/416.4; 123/509

(58) Field of Classification Search ..... 210/416.4
See application file for complete search history.

(56) References Cited

U.S. PATENT DOCUMENTS

| | | | | | |
|---|---|---|---|---|---|
| 4,279,232 | A | * | 7/1981 | Schuster et al. | 123/516 |
| 4,397,333 | A | * | 8/1983 | Liba et al. | 137/574 |
| 4,503,885 | A | * | 3/1985 | Hall | 137/574 |
| 4,637,351 | A | * | 1/1987 | Pakula | 123/25 J |
| 4,684,463 | A | * | 8/1987 | Mizusawa | 210/172.3 |
| 4,834,132 | A | * | 5/1989 | Sasaki et al. | 137/143 |
| 4,842,006 | A | * | 6/1989 | Scheurenbrand et al. | 137/202 |
| 4,911,134 | A | * | 3/1990 | Olsson | 123/514 |
| 5,084,166 | A | * | 1/1992 | Shiraga et al. | 210/172.4 |
| 5,289,810 | A | * | 3/1994 | Bauer et al. | 123/510 |
| 5,396,872 | A | * | 3/1995 | Ruger et al. | 123/514 |
| 5,564,397 | A | * | 10/1996 | Kleppner et al. | 123/514 |
| 5,645,011 | A | * | 7/1997 | Winkler et al. | 116/264 |
| 5,667,366 | A | * | 9/1997 | Reef et al. | 417/198 |
| 5,791,317 | A | * | 8/1998 | Eck | 123/510 |

(Continued)

FOREIGN PATENT DOCUMENTS

JP U H03-073656 7/1991

(Continued)

*Primary Examiner* — Robert James Popovics
(74) *Attorney, Agent, or Firm* — Manabu Kanesaka

(57) ABSTRACT

A filter device includes a first connection part 1 adapted to be connected to a fuel pump; a second connection part 21 adapted to be connected to a path for a returned portion of fuel; and a filter member 3 having an inner space 30 communicating with an inlet port 10 of the first connection part 1 and an outlet port 20 of the second connection part 2. A tubular member 22 has a leading edge 22*a* formed with the outlet port 20 of the second connection part 2. The leading edge 22*a* of the tubular member 22 is opened to be disposed in the inlet port 10 of the first connection part 1 so as to have a gap between an outer peripheral surface 22*b* of the tubular member 22 and an opening edge 10*a* of the inlet port 10 of the first connection part 1.

8 Claims, 3 Drawing Sheets

U.S. PATENT DOCUMENTS 5,941,279 A * 8/1999 Frank et al. ..... 137/574
6,098,600 A * 8/2000 Umetsu et al. ..... 123/514
6,109,299 A * 8/2000 Hashimoto et al. ..... 137/574
6,123,511 A * 9/2000 Sertier ..... 417/87
6,241,883 B1 * 6/2001 Noda ..... 210/172.3
6,260,542 B1 * 7/2001 Kochsmeier et al. ..... 123/509
6,273,131 B1 * 8/2001 Kleppner ..... 137/565.22
6,283,731 B1 * 9/2001 Yoshioka ..... 417/423.3
6,341,623 B1 * 1/2002 Channing ..... 137/565.22
6,343,589 B1 * 2/2002 Talaski et al. ..... 123/514
6,425,378 B1 * 7/2002 Frank ..... 123/514
6,513,503 B2 * 2/2003 Iwamoto et al. ..... 123/509
6,733,048 B2 * 5/2004 Kurihara et al. ..... 285/423
6,832,627 B2 * 12/2004 Braun et al. ..... 137/565.22
6,868,836 B2 * 3/2005 Buehler et al. ..... 123/509
6,913,295 B2 * 7/2005 Kimisawa et al. ..... 285/423
6,935,845 B2 * 8/2005 Berner et al. ..... 417/151
6,939,467 B2 * 9/2005 Deichmann et al. ..... 210/416.4
6,951,208 B2 * 10/2005 Milton ..... 123/509
6,955,158 B2 * 10/2005 Rumpf ..... 123/514
6,988,491 B2 * 1/2006 Burhenne et al. ..... 123/509
7,007,677 B2 * 3/2006 Toki et al. ..... 123/509
7,029,582 B2 * 4/2006 Sato et al. ..... 210/232
7,077,109 B2 * 7/2006 Lee ..... 123/514
7,090,262 B2 * 8/2006 Kurihara et al. ..... 285/423
7,134,568 B2 * 11/2006 Moriyama et al. ..... 220/563
7,182,869 B2 * 2/2007 Catlin et al. ..... 210/416.4
7,329,339 B2 * 2/2008 Kimisawa et al. ..... 210/136
7,387,111 B2 * 6/2008 Yu et al. ..... 123/509
7,429,322 B2 * 9/2008 Fujita et al. ..... 210/172.4
7,469,683 B2 * 12/2008 Mason et al. ..... 123/509
7,478,729 B2 * 1/2009 Sato et al. ..... 210/491
7,485,219 B2 * 2/2009 Urbahn et al. ..... 210/167.01
7,588,017 B2 * 9/2009 Briggs et al. ..... 123/509
7,901,572 B2 * 3/2011 Sato ..... 210/172.4
2002/0079694 A1 * 6/2002 Kurihara et al. ..... 285/21.1
2003/0178851 A1 * 9/2003 Kimisawa et al. ..... 285/423
2004/0056482 A1 * 3/2004 Kurihara et al. ..... 285/189
2005/0006300 A1 * 1/2005 Sato et al. ..... 210/416.4
2005/0023201 A1 * 2/2005 Sato ..... 210/172
2005/0029180 A1 * 2/2005 Kimisawa et al. ..... 210/172
2005/0061723 A1 * 3/2005 Matsushita ..... 210/171
2005/0109685 A1 * 5/2005 Fujita et al. ..... 210/172
2005/0150826 A1 * 7/2005 Sato et al. ..... 210/488
2005/0286103 A1 * 12/2005 Yu et al. ..... 359/198
2006/0016741 A1 * 1/2006 Moriyama et al. ..... 210/172
2006/0076287 A1 * 4/2006 Catlin et al. ..... 210/416.4
2006/0180535 A1 * 8/2006 Yu et al. ..... 210/172
2007/0246420 A1 * 10/2007 Sato ..... 210/416.4
2008/0173282 A1 * 7/2008 Briggs et al. ..... 123/506
2009/0039011 A1 * 2/2009 Sato et al. ..... 210/491
2009/0050551 A1 * 2/2009 Kimisawa et al. ..... 210/172.4
2009/0120858 A1 * 5/2009 Kojima et al. ..... 210/167.08
2010/0072120 A1 * 3/2010 Sato ..... 210/172.4

FOREIGN PATENT DOCUMENTS

JP H09-004537 1/1997
JP 2004-190489 7/2004
JP 2004-218566 8/2004
JP 2004-218567 8/2004

* cited by examiner

FILTER DEVICE UTILIZING RETURNED FUEL TO PROLONG FILTER LIFE

TECHNICAL FIELD

The present invention relates to an improved filter device, which is adapted to be attached to the fuel suction port of a fuel tank for an automobile, a motorcycle or the like in order to prevent water or a foreign material from being contained in the fuel carried to a combustion engine through the suction port.

BACKGROUND ART

Fuel is sucked from a fuel tank by a fuel pump through a filter device, and a portion of the sucked fuel, which is returned after pressure-regulation, is normally carried back into the fuel tank and is mixed with an unfiltered portion of the fuel remaining in the fuel tank. Since such a returned portion of the fuel has been already filtered by the filter device, it is unreasonable that the returned portion of the fuel is mixed with such an unfiltered portion of the fuel. From this point of view, there has been proposed a system wherein a fuel pump and a path for a returned portion of the fuel are connected at different positions to an upper portion of a filter device in a fuel tank (see Patent Document 1). However, this system simply carries back the returned portion of the fuel into the filter device since the path for the returned portion of the fuel is merely connected to the upper portion of the filter device. It is supposed that a flow of the returned portion of the fuel has an adverse effect on operation for sucking the fuel in this system since the path for the returned portion of the fuel is connected to the filter device at a position lateral to a path extending to the fuel pump and connected to the upper portion of the filter device.

Patent document 1: JP-9-4537

DISCLOSURE OF THE INVENTION

Object to be Accomplished by the Invention

It is an object of the present invention to provide a filter device, which allows not only a portion of a fuel returned after pressure-regulation to be carried back directly into a filter but also the returned portion of the fuel to be utilized to forcibly supply the fuel to a fuel pump.

Means to Accomplish the Object

In order to attain the object, the present invention provides a filter device includes the following elements (1) to (5):

(1) a first connection part adapted to be connected to a fuel pump;

(2) a second connection part adapted to be connected to a path (hereinbelow, referred to as the return path) for a portion of fuel sucked through the filter device by the fuel pump and returned to a fuel tank or a portion of fuel returned after pressure-regulation downstream the fuel pump in the fuel tank (hereinbelow, referred to as the returned fuel);

(3) a filter member having an inner space communicating with an inlet port of the first connection part and an outlet port of the second connection part;

(4) a tubular member having a leading edge formed with the outlet port of the second connection part;

(5) the leading edge of the tubular member being opened to be disposed in the inlet port of the first connection part so as to have a gap between an outer peripheral surface of the tubular member and an opening edge of the inlet port of the first connection part.

The returned fuel is introduced, through the second connection part, directly into the filter member forming the filter device. Since the outlet port of the second connection part is formed in the leading edge of the tubular member disposed in the inlet port of the first connection part, a jet pump effect is produced at least between the outer peripheral surface of the tubular member and the opening edge of the inlet port of the first connection part by the outflow of the returned fuel, with the result that a portion of the fuel outside the filter member is drawn into the filter member and further beyond the inlet port of the first connection part by the jet pump effect. Since the returned fuel has been already filtered by the filter device, it is possible to reduce the load on the filter member in terms of the lapse of time and to extend the service life of the filter member in comparison with a case where the returned fuel is returned outside the filter member. Even if the filter member is made smaller to have a reduced effective filtering area, it is easy to provide the filter member with a longer service life and to comply with a demand to make the filter device smaller. The present invention also contributes to a reduction in the load on the fuel pump.

The tubular member may have an inner diameter gradually decreasing toward the outlet port in a portion thereof close to the leading edge. In such a case, it is possible to increase the flow rate of the returned fuel at the outlet port, enhancing the jet pump effect.

The filter member may be formed of an outer shell member having filtering apertures for the fuel and a filtering medium covering the filtering apertures from inside the outer shell member, and the outer shell member may be integrally formed with the first connection part and the second connection part. In such a case, the filter device according to the present invention, which not only receives the returned fuel directly into the inner space of the filter member but also has a function of drawing a portion of the fuel outside the filter member into the filter member by utilizing the jet pump effect caused by receiving the returned fuel, can be properly incorporated into a fuel system of, e.g. an automobile by connecting the first connection part to the fuel pump and connecting the second connection part to the return path.

The outer shell member may have an upper portion integrally formed with the first connection part, and the outer shell member may have the upper portion or a lateral portion integrally formed with the second connection part. In such cases, the filter device according to the present invention may be mounted in such state that the filter member forming the filter device has a lower portion brought into contact with, e.g. a bottom portion of a fuel tank.

Effects of the Invention

The filter device according to the present invention has a reasonable structure in that a returned portion of fuel is directly carried back into a filter. The filter device according to the present invention can utilize the returned portion of the fuel to draw a fresh portion of the fuel into the filter and to forcibly supply a portion of the fuel in the filter to a fuel pump.

BEST MODE FOR CARRYING OUT THE INVENTION

Now, embodiments of the present invention will be described in reference to FIG. 1 to FIG. 3.

Figure 1:
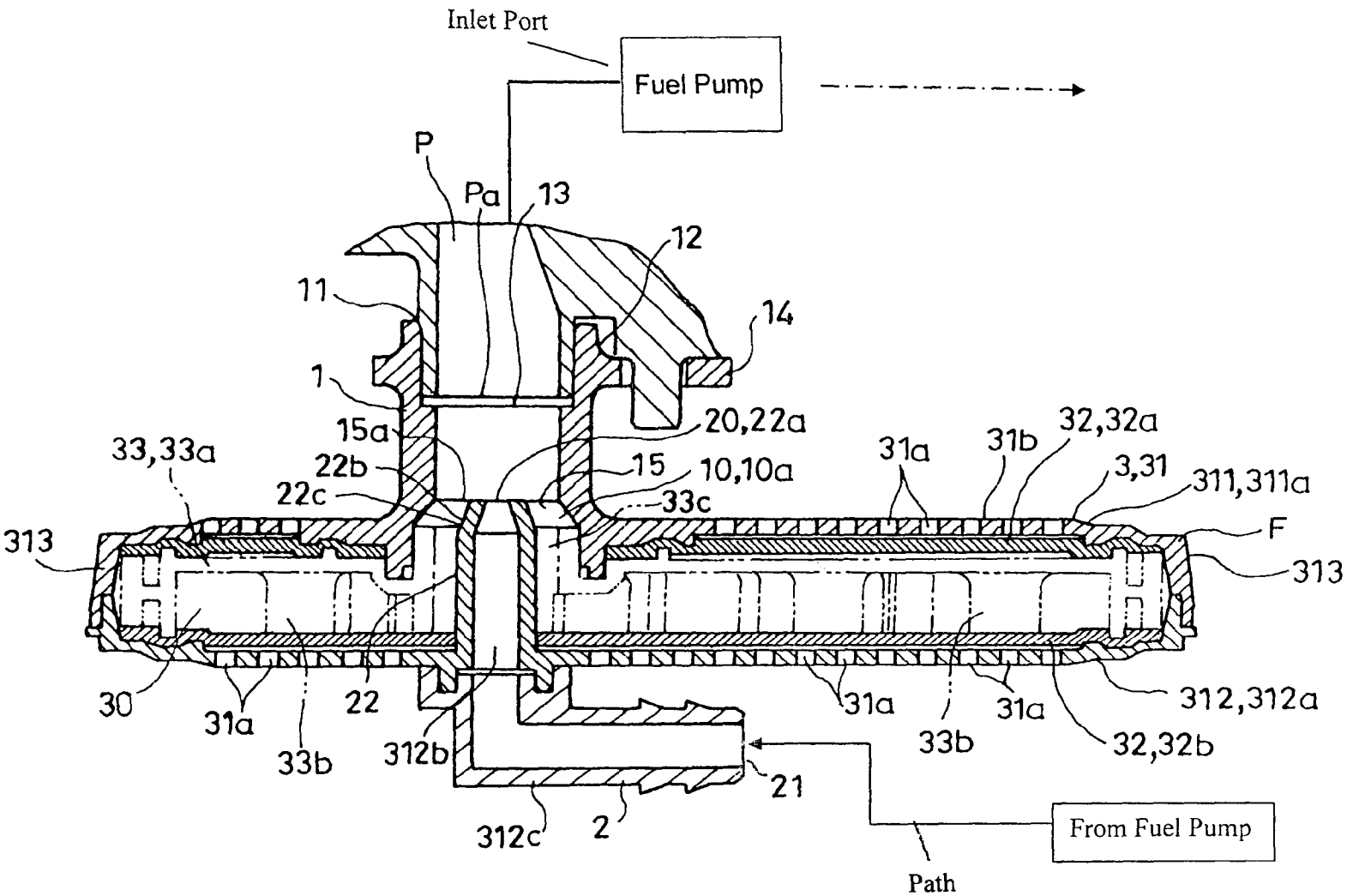
FIG. 1 is a cross-sectional view of the filter device according to an embodiment of the present invention.

In FIG. 1, the filter device F according to an embodiment of the present invention is shown in section. In FIG. 2, the filter device F according to another embodiment of the present invention is shown in section. In FIG. 3, the filter device F according to another embodiment of the present invention is shown in section (It should be noted that in each of FIG. 2 and FIG. 3, an outer shell member 31 forming the filter device F is shown, having filtering apertures 31*a*, a filtering medium 32 and a holder 33 omitted.)

The filter device F according to each of the embodiments is attached to a fuel suction port Pa of a fuel tank (not shown) for an automobile, a motorcycle or the like in order to prevent water or a foreign material from being contained in the fuel carried to a combustion engine through the suction port Pa.

The filter device F is typically attached to a suction pipe P so as to communicate the suction pipe with an inner space 30 of a filter through the suction port Pa, the suction pipe having a fuel suction opening in a fuel tank.

A fuel pump disposed in the fuel tank or a fuel pump disposed outside the fuel tank is utilized to supply fuel to an internal combustion engine through the filter device F attached to the fuel suction port Pa as described above.

The filter device F includes a first connection part 1 adapted to be connected to a portion of the fuel tank closer to the fuel pump, specifically the fuel suction port Pa, a second connection part 2 adapted to be connected to a path (hereinbelow, referred to as the return path) for returning, a portion of fuel sucked through the filter device F by the fuel pump and returned to the fuel tank or a portion of fuel returned after pressure-regulation downstream the fuel pump in the fuel tank (hereinbelow, referred to as the returned fuel); and a filter member 3 having the inner space 30 communicating with an inlet port 10 of the first connection part 1 and an outlet port 20 of the second connection part 2.

In other words, the inner space of the filter member 3 communicates with outside only through the inlet port 10 and the outlet port 20. The first connection part 1 has a connection port 11 for connection with the fuel suction opening Pa formed outside the filter member 3.

The second connection part 2 has a connection port 21 for connection with the return path formed outside the filter member 3.

The returned fuel is typically supposed to be one returned through a pressure-regulator from a passage between the fuel pump and the combustion engine (a passage downstream the fuel pump). In one case, the returned fuel is carried back into the fuel tank through this passage outside the fuel tank. In a case where the fuel tank has such a pressure-regulator disposed therein, the returned fuel is carried back into the fuel tank through this passage in the fuel tank.

The outlet port 20 of the second connection part 2 is formed at a leading edge 22*a* of a tubular member 22. In the filter device F, the leading edge 22*a* of the tubular member 22 is opened to be disposed in the inlet port 10 of the first connection part 1 so as to have a gap between an outer peripheral surface 22*b* of the tubular member 22 and an opening edge 10*a* of the inlet port 10 of the first connection part 1 for producing a jet pump effect.

By this arrangement, the returned fuel is introduced, through the second connection part 2, directly into the filter member 3 forming the filter device F. Since the outlet port 20 of the second connection part 2 is formed in the leading edge 22*a* of the tubular member 22 disposed in the inlet port 10 of the first connection part 1, a jet pump effect is produced at least between the outer peripheral surface 22*b* of the tubular member 22 and the opening edge 10*a* of the inlet port 10 of the first connection part 1 by the outflow of the returned fuel, with the result that a portion of the fuel outside the filter member 3 is drawn into the filter member 3 and further beyond the inlet port 10 of the first connection part 1 by the jet pump effect. Since the returned fuel has been already filtered by the filter device F, it is possible to reduce the load on the filter member 3 in terms of the lapse of time and to extend the service life of the filter member 3 in comparison with a case where the returned fuel is returned outside the filter member 3. Even if the filter member 3 is made smaller to have a reduced effective filtering area, it is easy to provide the filter member with a longer service life and to comply with a demand to make the filter device F smaller. The present invention also contributes to a reduction in the load on the fuel pump.

In each of the embodiments, the filter member 3 forming the filter device F is formed of the outer shell member 31 having the filtering apertures 31*a* formed therein to pass fuel therethrough, the filtering medium 32 for covering the filtering apertures 31*a* on an inner side of the outer shell member 31, and the holder 33 for the filtering medium.

In each of the shown embodiments, the outer shell member 31 is formed of an upper outer shell member 311 and a lower outer shell member 312, which are assembled to have a space between the inner sides of both upper and lower outer shell members 311 and 312 and to be closed between an outer edge of a surface portion 311*a* of the upper outer shell member 311 and an outer edge of a surface portion 312*a* of the lower outer shell member 312 throughout the entire periphery of the outer shell member. In other words, the outer shell member is closed throughout the entire periphery thereof by providing a rising peripheral wall 313 to one of the upper and lower outer shell members 311 and 312 or to each of the upper and lower outer shell members 311 and 312 and engaging both upper and lower outer shell members between the outer edge of the surface portion 311*a* of the upper outer shell member 311 and the outer edge of the surface portion 312*a* of the lower outer shell member 312. The space between the inner side of the upper outer shell member 311 and the inner side of the lower outer shell member 312 forms the inner space 30 of the filter member. In each of the shown embodiments, the plural filtering apertures 31*a* are formed as small apertures in the surface portion 311*a* of the upper outer shell member 311 and in the surface portion 312*a* of the lower outer shell member 312 to pass through the respective surface portions. The filtering medium 32 is formed of an upper filtering medium 32*a* and a lower filtering medium 32*b*, the upper filtering medium having a size to cover an area of the surface portion 311*a* of the upper outer shell member 311 with the filtering apertures 31*a* formed therein, and the lower filtering medium having a size to cover an area of the surface portion 312*a* of the lower outer shell member 312 with the filtering apertures 31*a* formed therein. In each of the shown embodiments, the first connection part 1 is integrally formed with the upper outer shell member 311. The first connection part 1 is formed in a tubular shape and has a lower end integrally connected to the surface portion 311*a* of the upper outer shell member 311. The first connection part is configured to project outward from the surface portion 311*a* of the upper outer shell member 311. The first connection part 1 has a circumferential step 13 formed on and around an inner side of an upper end thereof, i.e. an end close to the connection port 11 thereof so as to provide a large diameter portion 12 having a larger inner diameter and to face upward. The first connection part has a bracket 14 formed on a lateral outer side of the upper end thereof so as to project laterally. The lower end of the suction pipe P for connection with the fuel suction port Pa is inserted into the first connection part 1 from above to a position close to the circumferential step 13, and then is connected to the connection port 11 of the first connection part 1 at the fuel suction port Pa by fixing the lower end of the suction pipe P by use of the bracket 14. On the other hand, the lower end of the first connection part 1 is configured to communicate with the inlet port 10, which passes through the surface portion 311*a* of the upper outer shell member 311. In the embodiment shown in FIG. 1, the opening edge 10*a* of the inlet port 10 is rimmed with a circular sloping face 15, which is inclined in a direction to gradually narrow the inlet port 10 from the inner space 30 of the filter member toward outward. The leading edge 22*a* of the tubular member 22, which will be described later, have a circular sloping face 22*c* formed an outer periphery thereof so as to be inclined in a similar way to the circumferential sloping face 15. The fuel that has entered in the inner space 30 of the filter member is fed into the first connection part 1 through between both circumferential sloping faces 15 and 21. The holder 33 is formed of an upper frame 33*a* and plural legs 33*b* projecting downward from the upper frame 33*a* and has a connection opening 33*c* formed in the upper frame 33*a* for connection with the inlet port 10. The holder is housed in the inner space 30 of the filter member so as to communicate the connection opening 33*c* with the inlet port 10. The distance between an outer side of the upper frame 33*a* and the leading edges of the legs 33*b* is substantially equal to the distance between the surface portion 311*a* of the upper outer shell member 311 and the surface portion 312*a* of the lower outer shell member 312. By the holder 33 housed as described above, the upper filtering medium 32*a* and the lower filtering medium 32*b* are pressed against the surface portion 311*a* of the upper outer shell member 311 and the surface portion 312*a* of the lower shell member 312 from the side of the inner space 30 of the filter member, respectively.

The tubular member 22 has a portion close to the leading edge 22*a* inserted into the intake port 10 so as to position the leading edge 22*a* of the tubular member 22 at substantially the same level as a leading edge 15*a* of the circumferential sloping face 15 close to the connection port. In each of the embodiments, such a portion of the tubular member 22 close to the leading edge 22*a* has an inner diameter gradually decreasing toward the outlet port 20 so as to increase the flow rate of the returned fuel at the outlet port 20, enhancing the jet pump effect.

In the embodiment shown in FIG. 1, the tubular member 22 is integrally formed with the lower outer shell member 312 so as to have a top end formed with the outlet port 20 and a bottom end communicating with a through hole 312*b*, which is formed in a portion of the lower outer shell member 312 just under the inlet port 10. The lower outer shell member 312 has a bent tube 312*c* formed on an outer side so that the bent tube has one end fixed to the lower outer shell member 312 so as to communicate with the through hole 312*b* and extends downward, followed by being bent so as to extend laterally. In the shown embodiment, the bent tube has the other end serving as the connection port 21 in the second connection part 2 for the return path.

In the shown embodiment, the first connection part 1 and the second connection part 2 are integrally formed with the outer shell member 31. The filter device F, which not only receives the returned fuel directly into the inner space 30 of the filter member but also has the function of drawing a portion of the fuel outside the filter member 3 into the filter member 3 by utilizing the jet pump effect caused by receiving the returned fuel, may be properly incorporated into a fuel system of, e.g. an automobile by connecting the first connection part 1 to the fuel pump and connecting the second connection part 2 to the return path.

Figure 2:
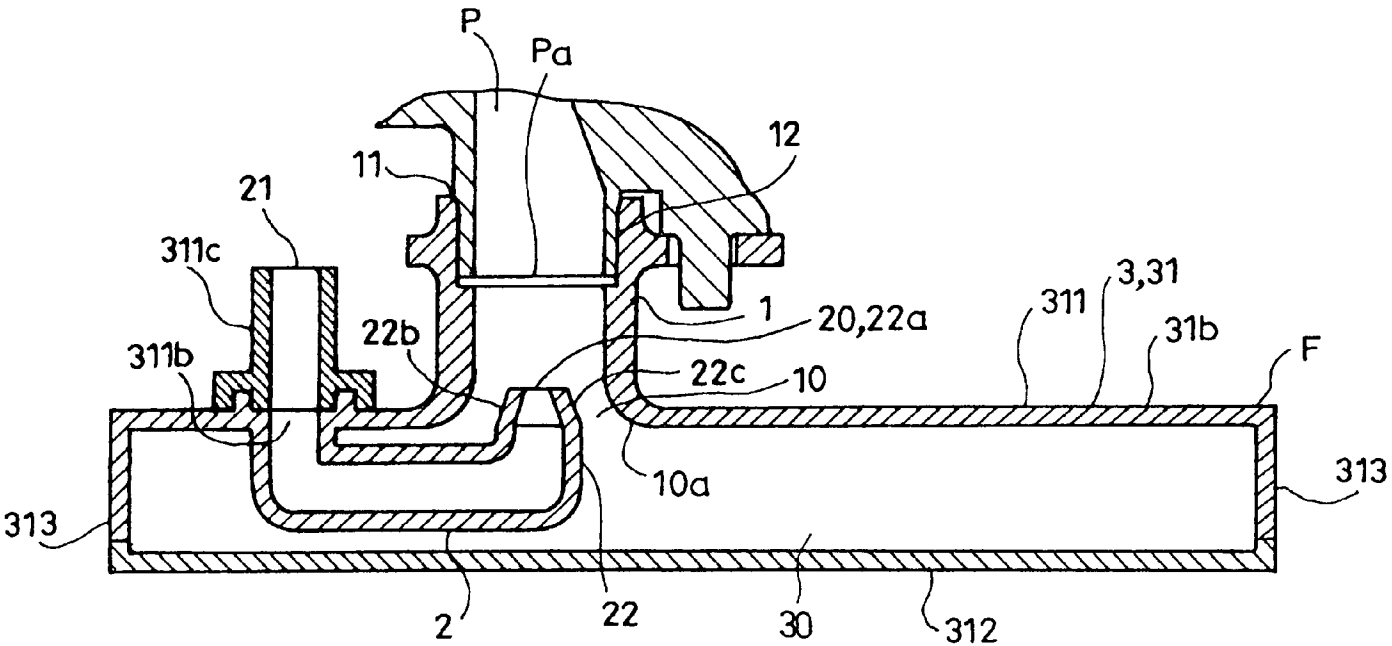
FIG. 2 is a cross-sectional view of the filter device according to another embodiment of the present invention.

In the embodiment shown in FIG. 2, an outer shell member 31 has a second connection part 2 integrally formed with an upper portion 31*b* thereof. In the shown embodiment, a tubular member 22 is formed integrally with an upper outer shell member 311 so as to have one end formed with the outlet port 20 and the other end communicating with a through hole 311*b*, which is formed in a portion of the upper outer shell member 311 lateral to a first connection part 1. In order to direct the outlet port 20 and the other end of the tubular member 22 upward, the tubular member 22 is bent at two portions of a connection portion between the one end and an intermediate portion and a connection portion between the other end and the intermediate portion. The upper outer shell member 311 has an outer side formed with a tube 311*c*, which has a lower end fixed to the upper outer shell 311 so as to communicate the lower end to the through hole 311*b* and to extend upward. In the shown embodiment, the tube 311*c* has an upper end serving as a connection port 21 in the second connection part 2 for the return path. In the shown embodiment as well, the first connection part 1 and the second connection part 2 are integrally formed with the outer shell 31. The filter device F, which not only receives the returned fuel directly into the inner space 30 of the filter member but also has the function of drawing a portion of the fuel outside the filter member 3 into the filter member 3 by utilizing the jet pump effect caused by receiving the returned fuel, may be properly incorporated into a fuel system of, e.g. an automobile by connecting the first connection part 1 to the fuel pump and connecting the second connection part 2 to the return path. In such a case, the filter device F may be mounted in such state that the filter member 3 forming the filter device F has a lower portion brought into contact with a bottom portion of a fuel tank or an inner bottom portion of a fuel pump module (an inner bottom portion of a casing which houses a fuel pump therein and forms a trough-shaped fuel pump module so as to draw fuel from the inside of a fuel tank thereinto).

Figure 3:
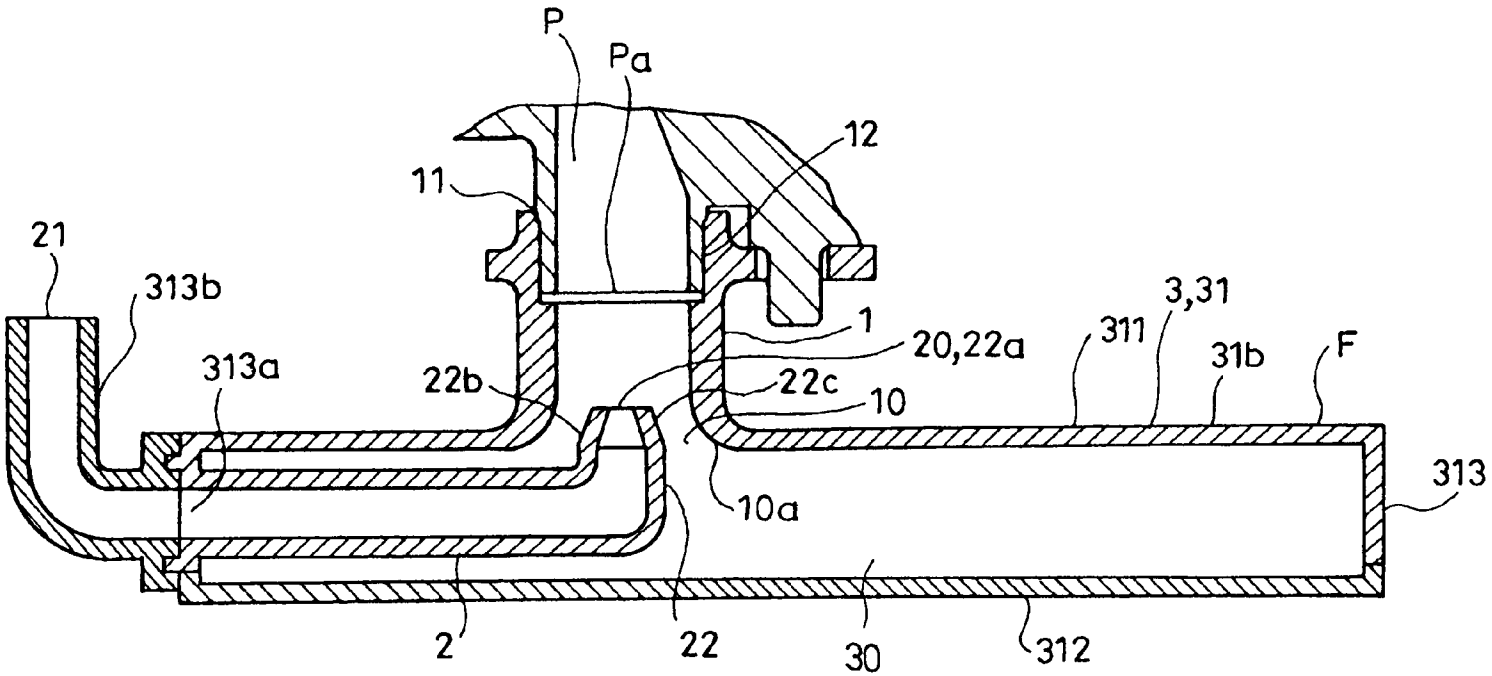
FIG. 3 is a cross-sectional view of the filter device according to another embodiment of the present invention.

In the embodiment shown in FIG. 3, an outer shell member 31 has a second connection part 2 integrally formed with a lateral portion thereof. In the shown embodiment, a tubular member 22 is formed integrally with the outer shell 31 so as to have one end formed with an outlet port 20 and the other end communicating with a through hole 313*a*, which is formed in a portion of the outer member 31 with a rising peripheral wall 313 formed therein. In order to face the outlet port 20 upward, the tubular member 22 is bent at a connection portion between the one end and an intermediate portion. The outer shell member 31 has a tube 313*b* formed on an outer side so that the tube has one end fixed to the outer shell 31 so as to communicate with the through hole 313*a* and to extend further. In the shown embodiment, the other end of the tube 313*b* serves as a connection port 21 in the second connection part 2 for the return path. In the shown embodiment as well, the first connection part 1 and the second connection part 2 are integrally formed with the outer shell member 31. The filter device F, which not only receives the returned fuel directly into the inner space 30 of the filter member but also has the function of drawing a portion of the fuel outside the filter member 3 into the filter member 3 by utilizing the jet pump effect caused by receiving the returned fuel, may be properly incorporated into a fuel system of, e.g. an automobile by connecting the first connection part 1 to the fuel pump and connecting the second connection part 2 to the return path. In such a case, the filter device F may be mounted in such state that the filter member 3 forming the filter device F has a lower portion brought into contact with, e.g. a bottom portion of a fuel tank.

The entire disclosure of Japanese Patent Application No. 2006-074711 filed on Mar. 17, 2006 including specification, claims, drawings and summary is incorporated herein by reference in its entirety.

The invention claimed is:

1. A filter device comprising:

a first connection part located at an upstream of a fuel pump and adapted to be connected to an inlet port of the fuel pump;

a second connection part adapted to be connected to a path downstream of the fuel pump for a returned portion of fuel sucked through the filter device by the fuel pump;

a filter member for filtering fuel, having an inner space in which filtered fuel is disposed, the inner space communicating with an inlet port of the first connection part and an outlet port of the second connection part so that the returned fuel from the fuel pump is directly delivered into the inner space via the outlet port of the second connection part; and a tubular member having a leading edge and formed integrally with the outlet port of the second connection part.

2. The filter device according to claim 1, wherein the filter member comprises an outer shell member having filtering apertures for the fuel and a filtering medium covering the filtering apertures from inside the outer shell member; and wherein the outer shell member is integrally formed with the first connection part and the second connection part.

3. The filter device according to claim 1, wherein the tubular member includes a first end communicated with the outlet port of the second connection part, and a second end disposed proximate the inlet port of the first connection part.

4. The filter device according to claim 3, wherein the second end of tubular member has an inner diameter gradually decreasing toward the outlet port in a portion thereof close to the second end.

5. The filter device according to claim 3, wherein the second end of the tubular member is disposed with an opening of the inlet port of the first connection part so as to discharge the returned fuel into the opening of the inlet port of the first connection part and so as to define a gap between an outer peripheral surface of the second end and the opening of the inlet port of the first connection part.

6. The filter device according to claim 3, wherein a gap between an outer peripheral surface of the tubular member and an opening end of the inlet port of the first connection part, defines a jet pump adapted to increase a pressure in the fuel at the inlet port of the fuel pump and to reduce a load on the fuel pump.

7. The filter device according to claim 1, wherein the outer shell member has an upper portion integrally formed with the first connection part, and the outer shell member has the upper portion or a lateral portion integrally formed with the second connection part.

8. The filter device according to claim 1, wherein the inlet port of the first connection part and the outlet port of the second connection part are located in the inner space of the filter member, the fuel freshly passing through a filtering medium being sucked into the inlet port of the first connection part together with the fuel returned from the fuel pump through the second connection part.

* * * * *